United States Patent [19]

Imazu et al.

[11] Patent Number: 4,863,063

[45] Date of Patent: Sep. 5, 1989

[54] METAL VESSEL HAVING CIRCUMFERENTIAL SIDE SEAM

[75] Inventors: Katsuhiro Imazu, Yokohama; Makoto Horiguchi, Fujisawa; Hiroshi Matsubayashi, Kamakura; Seishichi Kobayashi, Yokohama; Kazuo Taira, Tokyo; Hiroshi Ueno, Yokosuka, all of Japan

[73] Assignee: Toyo Seikan Kaisha, Ltd., Tokyo, Japan

[21] Appl. No.: 753,809

[22] Filed: Jul. 9, 1985

Related U.S. Application Data

[63] Continuation of Ser. No. 550,607, Nov. 19, 1983, abandoned.

[30] Foreign Application Priority Data

Nov. 15, 1982 [JP] Japan ..... 57-198883

[51] Int. Cl.[4] ..... B65D 1/16; B65D 8/22; B65D 25/14

[52] U.S. Cl. ..... 220/458; 220/1 BC; 220/67; 220/75

[58] Field of Search ..... 220/458, 81 R, 66, 67, 220/1 BC, 80, 75; 72/46, 47

[56] References Cited

U.S. PATENT DOCUMENTS

| | | | |
|---|---|---|---|
| 3,819,085 | 6/1974 | Rohowetz | 220/81 X |
| 4,032,678 | 6/1977 | Perfetti et al. | 72/46 X |
| 4,054,227 | 10/1977 | Saunders | 220/458 |
| 4,350,261 | 9/1982 | Roth | 220/67 X |
| 4,405,058 | 9/1983 | Phalin | 220/66 X |
| 4,412,440 | 11/1983 | Phalin et al. | 72/46 |
| 4,452,374 | 6/1984 | Hitchcock et al. | 72/46 X |
| 4,472,219 | 9/1984 | Taira et al. | 220/67 X |

*Primary Examiner*—Allan N. Shoap

*Attorney, Agent, or Firm*—Sherman and Shalloway

[57] ABSTRACT

A metal vessel has a metal bottomed cup-shaped lower member and a metal cup-shaped upper member, the upper and lower members being bonded together by a circumferential side seam. The upper member has a pouring mouth having a small diameter in the central portion thereof. The metal vessel is formed by lap-bonding the circumferential open ends of both the upper and lower members. The side wall of the upper member is formed by subjecting a primer-coated tin-plated steel sheet to draw forming at a side wall plastic forming ratio R of from 1.1 to 1.8; the side wall plastic forming ratio R being defined by the following formula:

$$R = \left( \frac{4W}{\pi t \rho} + D_0^2 \right)^{\frac{1}{2}} / D_1$$

wherein W stands for the weight (g) of the blank of the upper member, t stands for the thickness (cm) of the blank of the upper member at the side wall, $\rho$ stands for the density (g/cm$^3$) of the blank of the upper member, $D_0$ stands for the inner diameter (cm) of pouring mouth of the upper member, and $D_1$ stands for the average inner diameter (cm) of the side wall.

In the circumferential bonded portion, the side wall of the lower member is bonded to the side wall of the upper member through an organic adhesive interposed between a primer coating applied to the side wall of the lower member and a primer coating applied to the side wall of the upper member. The bonding strength and resistance to leakage of the lap-bonded circumferential side seam are improved.

10 Claims, 4 Drawing Sheets

METAL VESSEL HAVING CIRCUMFERENTIAL SIDE SEAM

This application is a continuation, of application Ser. No. 550,607, filed Nov. 19, 1983, abandoned.

BACKGROUND OF THE INVENTION (1) Field of the Invention

The present invention relates to a metal vessel having a circumferential side seam. More particularly, the invention relates to a vessel of a tin-plated steel sheet, which has improved adhesion and corrosion resistance in its circumferential side seam.

(2) Description of the Prior Art

A so-called draw-ironed can is widely used as a vessel for a content having a spontaneous pressure, such as beer or carbonated drink.

This draw-ironed can is prepared by draw-forming a metal blank punched into a disc or the like between a drawing punch and a drawing die into a cup and ironing the side wall of the cup between an ironing punch and an ironing die to reduce the thickness of the side wall.

In the draw-ironed can, in order to reduce the weight of the can per unit volume and lower the cost of the metal blank necessary for the production of the can, it is greatly desired to reduce the thickness of the side wall as much as possible.

However, this desired is greatly limited in the production of cans, and the desire has not been satisfied. More specifically, when the thickness of the side wall of the can body is reduced, the buckling strength will naturally be reduced according to the reduction of the thickness of the side wall. At the step of double-seaming a lid to the can body, the axial load applied to the can body in a seamer is in the range of 120 to 200 Kg, and if the thickness of the side wall portion is reduced below a certain limit, double seaming of a lid to the can body becomes difficult.

The structurally weakest portion in a draw-ironed can is that portion of double seaming between the lid and can body, and breakage or leakage is caused in this portion under a shock given on falling or the like.

A metal bottle formed by lap-bonding open ends of cup-shaped upper and lower members is advantageous in that even if the thickness of the material constituting the seam is extremely small, the bottle can resist a shock of up to the shear strength of the seam irrespective of the thickness of the material and since double seaming is not necessary, the thickness of the side wall of the vessel can be reduced without a fear of buckling.

However, when the circumferential open ends of these upper and lower members are lap-bonded, it is difficult to provide a bonded circumferential seam cpable of resisting a high shear force and excelling in the creep resistance.

In case of straight lap bonding of a can body, both the ends of the formed seam are mechanically fixed by double seaming with can lids, but in case of the above-mentioned circumferential side seam, the entire circumference of the seam is not mechanically fixed at all and the size of the seam is readily changed. Moreover, since the diameter of the open ends are going to change according to the change of the temperature, a stress is readily generated in the adhesive layer. Furthermore, in many cases, the thickness of the open ends to be formed into a seam is reduced, and the formed seam is readily changed by an external force. For the foregoing reasons, it is a problem how to form bondings having a high resistance to a shearing force between the metal blank and the primer coating and between the coating and the adhesive layer.

Among steel blanks, tinplate, that is, a tin-plated steel sheet, has an excellent formability capable of resisting drawing, deep drawing, draw-ironing and the like. However, this blank is insufficient in the adhesion to the coating, and in case of a metal vessel having the above-mentioned circumferential side seam, even if an adhesive having excellent bonding characteristics is used, peeling is readily caused between the tin-plated steel sheet and the coating of an adhesive primer, resulting in such defects as leakage, insufficient sealing, corrosion of the metal blank and dissolution of the metal component into the vessel contents.

SUMMARY OF THE INVENTION

It is a primary object of the present invention to provide a vessel of a tin-plated steel sheet having a circumferential side seam, in which the above-mentioned defects are overcome.

Another object of the present invention is to provide a vessel having a circumferential side seam, in which a bonding capable of resisting high shearing force is formed between a tin-plated steel sheet substrate and a primer coating in the portion of the circumferential side seam.

More specifically, in accordance with the present invention, there is provided a metal vessel which comprises a bottomed cup-shaped lower member composed of a metal and a cup-shaped upper member composed of a metal, which has a pouring mouth having a small diameter in the central portion thereof, the metal vessel being formed by lap-bonding the circumferential open ends of both the upper and lower members, wherein the side wall of the upper member is formed by subjecting a primer-coated tin-plated steel sheet to draw forming at a side wall plastic forming ratio R of from 1.1 to 1.8, the side wall plastic forming ratio R beIng defined by the following formula:

$$R = \left( \frac{4W}{\pi t \rho} + D_0^2 \right)^{\frac{1}{2}} / D_1 \quad (1)$$

wherein W stands for the weight (g) of the blank of the upper member, t stands for the thickness (cm) of the blank of the upper member at the side wall, $\rho$ stands for the density (g/cm$^3$) of the blank of the upper member, $D_O$ stands for the inner diameter (cm) of the pouring mouth of the upper member, and $D_1$ stands for the average inner diameter (cm) of the side wall, and in the circumferential bonded portion, the side wall of the lower member is bonded to the side wall of the upper member through an organic adhesive interposed between a primer coating applied to the side wall of the lower member and a primer coating applied to the side wall of the upper member.

DETAILED DESCRIPTION OF THE PREFERRED EMBODIMENTS

The present invention will now be described in detail with reference to the accompanying drawings.

Figure 2:
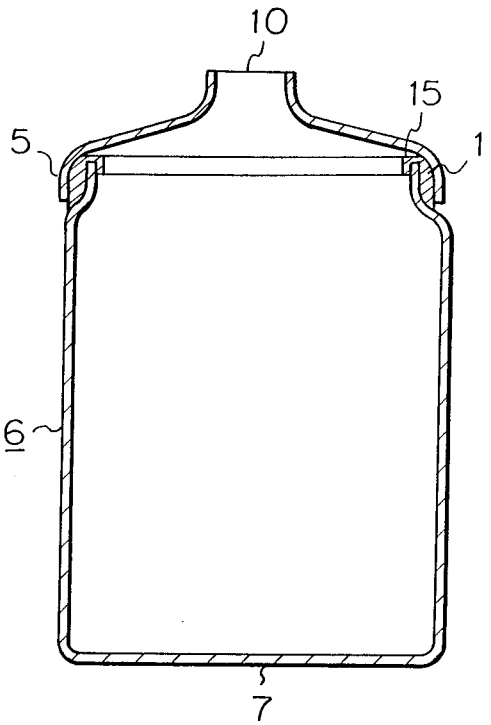
FIG. 2 is a sectional view illustrating a most preferred embodiment of the draw-ironed metal vessel according to the present invention.
Figure 1:
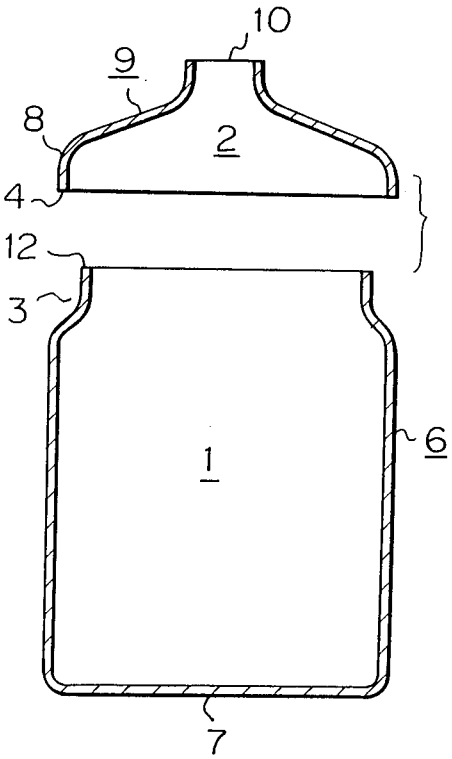
FIG. 1 is a sectional view showing independently upper and lower members of the metal vessel according to the present invention.
Figure 3:
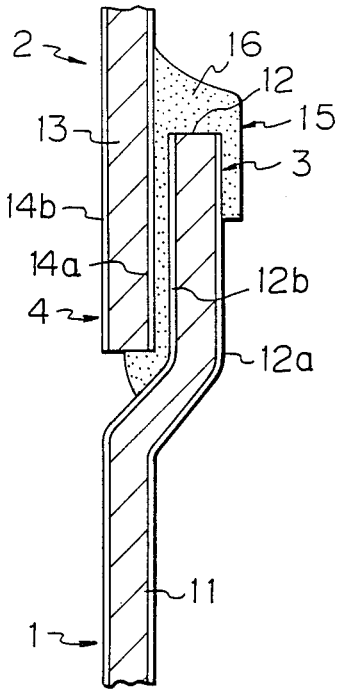
FIG. 3 is an enlarged sectional view showing the lap-bonded portions of upper and lower members.

Referring to FIGS. 1 through 3 illustrating one embodiment of the metal vessel of the present invention, this bottle-shaped vessel comprises a lower member 1 composed of a seamless cup-shaped body of a tin-plated steel sheet and an upper member 2 composed of a seamless cup-shaped body of a primer-coated, tin-plated steel sheet. Open ends 3 and 4 of these cup-shaped bodies are lap-bonded together to form a circumferential side seam 5, whereby both the lower and upper members 1 and 2 are integrated into a vessel.

In this embodiment, the lower member 1 is a cup comprising a tall thin side wall portion 6 formed by high draw-ironing forming of a tinplate blank and a thick bottom 7 which is not substantially ironed, and the upper member 2 comprises short side wall 8 and top wall 9 formed by draw forming of a metal blank. The height of the side wall portion 8 of the upper member 2 is equal to or slightly larger than the width of the lap seam 5. The surface of the top wall 9 of the upper member 2 is tapered upward, and a pouring mouth 10 for filling or discharging the contents of the vessel is formed at the center of the top wall 9. Thus, the upper member 2 is bonded in the form of a so-called shoulder and neck of a bottle to the lower member 1.

The side wall 6 of the lower member 1 has a diameter substantially equal to the diameter of the side wall 8 of the upper member 2. In the embodiment shown in FIG. 1, the diameter of the open end portion 3 of the lower member 1 is made smaller than the diameter of the other barrel portion by necking forming conducted on a part adjacent to the open end 3 and this open end portion 3 is fitted and inserted in the open end portion 4 of the upper member 2 having a larger diameter.

As is apparent from the enlarged sectional view of FIG. 3, the open end portion 3 of the lower member 1 comprises a draw-ironed tinplate substrate 11 and adhesive primer coatings 12*a* and 12*b* applied after draw-ironing to the surface of the substrate 11, and the open end portion 4 of the upper member 2 comprises a drawn tinplate substrate 13 and adhesive primer coatings 14*a* and 14*b* applied before drawing to the surface of the substrate 13. An adhesive layer 15 is formed between the outer surface of the open end portion 3 of the lower member 1 and the inner surface of the open end portion 4 of the upper member 2 to effect bonding and fixation of the lower and upper members. Thus, it is seen that in the circumferential side seam 5, bonding is effected in the arrangement order of the tinplate substrate 11, the primer layer 12*b*, the adhesive layer 15, the primer layer 14*a* and the tinplate substrate 13. In this embodiment, a part of the adhesive 15 is protruded from the seam 5 to form a covering layer 16 for a cut edge 12 of the metal blank located on the inner side of the seam.

In the present invention, the side wall 6 of the lower member, which is composed of tinplate, is ironed so that the ironing ratio ($R_I$), defined by the following formula:

$$R_I = \frac{T_B - T_W}{T_B} \times 100 \quad (2)$$

wherein $T_B$ stands for the thickness of the bottom wall of the cup-shaped body and $T_W$ stands for the thickness of the side wall of the cup-shaped body, is at least 20%, especially 30 to 80%, and the side wall 8 of the upper member, which is composed of coated tinplate, is drawn so that the side wall plastic forming ratio (R) defined by the above-mentioned formula (1) is in the range of from 1.1 to 1.8, especially from 1.15 to 1.6. By dint of this characteristic feature, the adhesion between the tinplate substrate 11 and the adhesive primer coating 12*b* and the adhesion between the tinplate substrate 13 and the adhesive primer coating 14*a* can be prominently improved, and it is possible to increase the bonding strength of the lap seam, improve the sealing property and control dissolution of the metal into the content.

Figure 4:
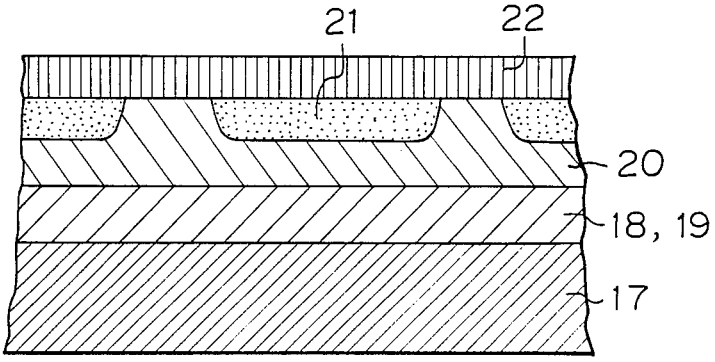
Fig. 4 PRIOR ART
FIG. 4 is an enlarged sectional view illustrating an ordinary coated tinplate blank.

Referring to FIG. 4 which is an enlarged sectional view of an ordinary coated tinplate blank, this tinplate substrate comprises a rolled steel plate substrate 17 and a tin plating layer 18, and in some cases, a tin-iron alloy layer 19 formed by thermal diffusion of iron and tin is present between the steel substrate 17 and the tin plating layer 18. A tin oxide layer 20 is inevitably formedmore or less on the tin plating layer 18, and a phosphate/chromate treatment layer 21 may be formed on the tin oxide layer 20 to prevent the growth of the tin oxide layer. An adhesive primer layer 22 is present on these layers.

As the result of our research, it was found that when an ordinary coated tinplate is used for formation of a lap seam by bonding, the bonding strength of the formed lap seam is relatively low and this is due to a low mechanical strength of the tin oxide layer per se and a low adhesion of the tin oxide layer to the metallic tin layer or coating layer (or the film formed by the phosphate and/or chromate treatment), and that when a shearing force is imposed on this lap seam, interlamina peeling is caused between the oxide layer and the coating layer or metallic tin layer, or bonding fracture is caused by cohesive failure of the oxide layer per se.

In contrast, if the tinplate blank for the lower member is highly ironed according to the present invention, the above-mentioned tin oxide layer 20 is removed by this ironing and a fresh metallic tin layer 18 is exposed, and if a primer coating layer is formed on this metallic tin layer 18, if necessary after a phosphate and/or chromate treatment, the adhesion between the tinplate blank and the primer coating is prominently improved.

Furthermore, if the primer-coated tinplate blank is subjected to draw forming at the above-mentioned side wall plastic forming ratio, the adhesion or bonding strength between the primer coating and the tinplate blank is prominently improved. This is an unexpected effect attained by the present invention.

The reason why the adhesion between the adhesive primer coating and the tinplate blank in the lap bonded seam portion of the metal vessel of present invention is capable of resisting a shearing force has not completely been elucidated, but it is believed that this improvement will be attained according to the following mechanism.

Figure 5:
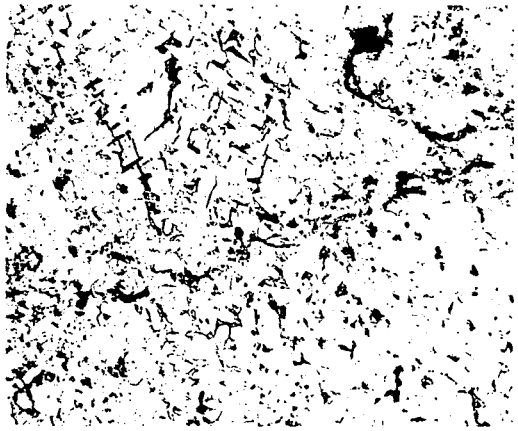
FIGS. 5 and 6 are electron microscope photographs of the structure of the tin oxide layer in the unprocessed state and the structure of the tin oxide layer after processing according to the present invention.
Figure 6:
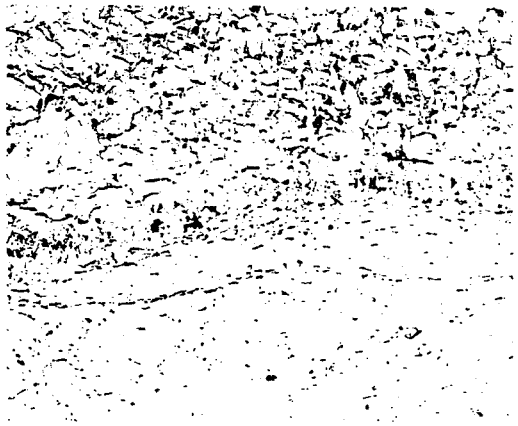
Figure 7:
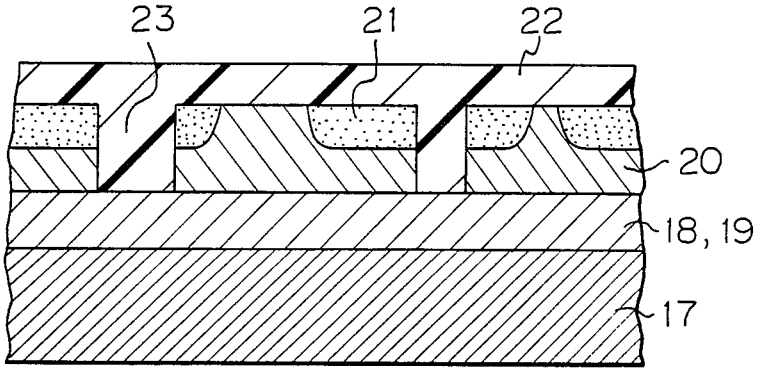
FIG. 7 is an enlarged sectional view illustrating a coated tinplate blank of an upper member formed by draw processing according to the present invention.

FIGS. 5 and 6 are electron microscope photographs (10,000 magnifications) of the structure of tin oxide layers of an unformed coated tinplate blank and a coated tinplate blank drawn at a side wall plastic forming ratio of 1.4, each tin oxide layer being formed according to customary procedures by peeling the coating layer with sulfuric acid and peeling the metallic tin layer according to the amalgam method. In the unformed coated tinplate blank, the tin oxide layer is present in the substantially continuous complete form (see FIG. 5), but in the coated tinplate blank formed at a side wall plastic forming ratio within the range specified in the present invention, many cracks are formed in the tin oxide layer (see FIG. 6). As shown in the imaginary section of FIG. 7, parts of the tin oxide layer 20 are removed to expose the underlying parts of the metallic thin layer 18, and since a high pressure and a high temperature are applied to the coating 22 under the draw forming condition, the coating is melted and deformed to flow in the cracks so that the tin oxide-removed parts (cracks) are filled with the coating in contact with the exposed metallic tin layer 18 and a strong bonding is formed between the metallic tin layer 18 and the coating 22 in these parts 23, and an anchoring effect is given to the coating 22 by these parts 23. As the result, a structure having a high mechanical resistance to a shearing force acting in the plane direction is provided, and the above-mentioned improvement is attained.

In the present invention, a tinplate blank having a tin coating weight of 0.1 to 1.0 pound, especially 0.15 to 0.75 pound per base box is preferably used. A non-reflow plate (matte plate) having an as-electrolytic tin layer or a reflow plate (brite plate) having an electrolytic tin layer which has been subjected to a deposited tin layer melting treatment may be used as the tinplate blank. It is preferred that the thickness of the tinplate blank for preparing the lower member by draw-ironing be 0.20 to 0.50 mm, especially 0.20 to 0.45 mm, and the thickness of the tinplate blank for preparing the upper member by drawing be 0.15 to 0.30 mm, especially 0.15 to 0.25 mm.

For the production of a draw-ironed cup for the lower member, the above-mentioned tinplate blank is punched into a disc or the like, and the disc or the like is subjected to single-stage or multiple-stage drawing between a drawing punch and a drawing die and the formed cup is subjected to multiple-stage ironing between an ironing punch and an ironing die. These drawing and ironing operations can be carried out udner known conditions except that the ironing ratio is controlled within the above-mentioned range. The ironing operation is carried out so that the ironing ratio is within the above-mentioned range and the thickness (Tw) of the side wall formed by ironing is 0.05 to 0.20 mm, especially 0.06 to 0.17. mm. In order to prevent the open end portion of the cup from being damaged at the necking step, it is preferred that the ironing ratio of this open end portion be lower by 5 to 30% than the ironing ratio of the other side wall portion. For this purpose, there may be adopted a method in which ironing is carried out in at least three stages while gradually reducing the gap between the punch and die and at the final stage of ironing the open end portion of the cup is not ironed.

Necking processing of the draw-ironed cup is carried out so that the lower member is exactly fitted with the upper member. In the present invention, if the dimensions of both the open end portions to be lap-bonded to form a seam be selected so that the relation of $r_O - r_I < d_A$ in which $r_I$ stands for the outer diameter of the open end portion located on the inner side, $r_O$ stands for the inner diameter of the open end portion located on the outer side and $d_A$ stands for the thickness of the adhesive layer to be interposed between both the open portions is satisfied, both the open end portions always press the adhesive layer, and tight bonding and assured sealing in the seam can be attained.

The draw-ironed cup is subjected to trimming, and if necessary, a washing treatment, for example, a chemical surface treatment with a phosphate and/or a chromate, is carried out. Then, an anti-corrosive primer acting also as a protective paint is applied to the surface of the cup. In the present invention, by the chemical surface treatment of the draw-ironed cup, the edge of the open end portion of the cup is inevitably chemically surface-treated, and even if this open end portion is located on the inner side of the seam and is exposed to the content, a high corrosion resistance is promised. Furthermore, the adhesion to the adhesive layer is improved and also the adhesion to a paint or resin coating to be applied afterward can be improved.

An optional primer can be used as the protective paint. For example, there may be used modified epoxy paints such as a phenol-epoxy paint and an amino-epoxy paint, vinyl and modified vinyl paints such as a vinyl chloride-vinyl acetate copolymer, a saponified vinyl chloride-vinyl acetate copolymer, a vinyl chloride-vinyl acetate-maleic anhydride copolymer, an epoxy-modified vinyl resin paint, an epoxyamino-modified vinyl resin paint and an epoxyphenol-modified vinyl resin paint, acrylic resin paints, and synthetic rubber paints such as a styrene-butadiene copolymer. These paints may beused singly or in the form of mixtures of two or more of them.

The protective paint is applied in the form of an organic solvent solution such as an enamel or lacquer or an aqueous dispersion or solution to the cup by spray coating, dip coating, electrostatic deposition or electrophoresis coating. Of course, if the resin paint is thermosetting, the coated paint is baked according to need.

The drawn cup acting as the upper member is formed by drawing a coated tinplate blank by a press mold or a drawing punch and a drawing die so that the side wall plastic forming ratio is within the above-mentioned range. The top wall of the formed cup is punched to form a pouring mouth, whereby the upper member is formed.

The side wall plastic forming ratio (R) defined by the formula (1) is a dimensionless number which corresponds substantially to the draw ratio. If this plastic forming ratio is smaller than 1.1, the bonding or adhesion between the primer coating and the tinplate blank is not practically improved, and if the plastic forming ratio is larger than 1.8, the fracture of the bonding interface between the coating and the tinplate blank is increased or breakage or peeling of the coating per se is caused.

The coating of the coated tinplate blank formed into the upper member may be the same as or different from the primer coating to be applied to the lower member. However, since this coating per se is subjected to drawing and should show an excellent adhesion after this forming, it is preferred that this coating should have an elasticity modulus of $10^7$ to $10^{12}$ dyne/cm$^2$, especially $10^8$ to $10^{11}$ dyne/cm$^2$. If the elasticity modulus is too high and exceeds the above range, the effect of improving the bonding force to the tinplate blank by drawing is not attained in some cases. If the elasticity modulus is too low and below the above range, the mechanical characteristics of the coating per se tend to be degraded. The elasticity modulus can be controlled within the above-mentioned range by appropriately selecting the coating-forming resin and the baking conditions (curing conditions).

The lap-bonding of the lower and upper members is carried out advantageously by using an adhesive. At this bonding, an adhesive is beforehand applied to either or both of the open end portions to be bonded, of the lower and upper members, and afterward both open end portions are fitted.

An optional adhesive composed of a heat-fusible thermoplastic resin is used as the adhesive. It is preferred that the melting point or softening point of the adhesive resin be 130° to 240° C. As preferred examples, there can be mentioned nylon type adhesives such as nylon 13, nylon 12, nylon 11, nylon 6–12 and copolyamides and blends thereof, polyester type adhesives such as polyethylene terephthalate/isophthalate and polyetetamethylene terephthalate/isophthalate, and olefin type adhesives such as an acid-modified olefin resin, an ethylene/acrylic acid ester copolymer, an ion-cross-linked olefin copolymer (ionomer) and an ethylene-vinyl acetate copolymer.

The adhesive is applied in the form of a film, powder, dispersion or solution to the open end portions to be bonded and a uniform hot-adhesive layer is formed along the entire circumference of the open end portions, When the lower member is fitted with the upper member, the open end portion to be located on the outer side of the lap seam is heated to increase the diameter thereof or the open end portion to be located on the inner side of the lap seam is cooled to diminish the diameter thereof, whereby fitting of both the members is made easier. When this means is adopted even if the relation defined by the above-mentioned inequality is established among the inner diameter of the outer open end portion, the outer diameter of the inner open end portion and the thickness of the adhesive layer, fitting can be accomplished easily.

After the fitting operation, the formed lap seam is heated to melt the adhesive layer and then, the lap seam is cooled to effect bonding and sealing in the seam. Since the adhesive layer is melted in the state where both the edges are pressed, bonding and sealing of the lap seam become complete. Heating of the lap seam is advantageously accomplished by high frequency induction heating or the like.

The vessel of the present invention is especially valuable as a vessel for a content having a spontaneous pressure such as carbonated drink, beer or foaming spirit or as an inner pressure vessel in which nitrogen gas or liquefied nitrogen is packed together with a content.

The present invention will now be described in detail with reference to the following Examples that by no means limit the scope of the invention.

EXAMPLE 1

A bright tin-plated steel sheet (T-2; tin coating weight of #50/50) having a thickness of 0.30 mm was punched into a disc having a diameter of 120 mm, and the disc was draw-formed into a cup having an inner diameter of 85 mm between a drawing punch and a drawing die according to customary procedures.

This cup-shaped formed body was subjected to redrawing and was then ironed at an ironing ratio of 66.7% by using an ironing punch having a diameter of 65.3 mm and three ironing dies. Then, the so-formed lower member was subjected to panel forming according to known means.

The dimension and physical values of the lower member were as follows:

Thickness ($T_B$) of bottom: 0.30 mm
Thickness ($T_W$) of side wall: 0.100 mm
Ironing ratio ($R_T$): 66.7%
Inner diameter of side wall: 65.3 mm
Outer diameter of side wall: 65.5 mm
Height of lower member: 110 mm The inner and outer surfaces of the lower member were degreased and subjected to a phosphate treatment according to known procedures, and the outer surface of the lower member, except a portion of a width of about 5 mm from the open end, was coated with a white coat composed of a modified acrylic resin and was then printed. Then, a finishing varnish of the epoxy ester type was applied to the entire outer surface and baked.

Then, the inner surface of the lower member was coated with an epoxy-urea type lacquer, followed by baking and necking (the outer diameter of the necked portion was 64.95 mm). Then, a copolyester type adhesive was coated on the necked portion along the entire circumference with a width of about 5 mm according to customary procedures.

An upper member was prepared by punching a bright tin-plated steel sheet (T-1; tin coating weight of #50/50) having a thickness of 0.23 mm, on both the surfaces of which had been coated in advance with an epoxy type lacquer, into a disc having a diameter of 90 mm, subjecting the disc to customary press forming and forming a liquid-pouring mouth at the center of the top wall.

The dimensions and physical values of the upper member were as follows:

Thickness of side wall: 0.23 mm
Weight of upper member: 11.07 g
Inner diameter of pouring mouth: 21.6 mm
Average inner diameter of side wall: 64.5 mm
Plastic forming ratio (R): 1.41

The upper member was fitted with the circumferentially adhesive-applied lower member, and the adhesive was melted at about 220° C. and the assembly was cooled to effect bonding and form a metal vessel.

The dimensions and physical values of the metal can comprising the upper and lower members were as follows:

Height of can body: 122.5 mm
Outer diameter of lower member: 65.5 mm
Outer diameter of side wall of upper member: 64.96 mm
Length of fitted portion: 5.0–5.5 mm
Weight of can body: 39–40 g.

The metal vessel was cold-filled with (A) cola or (B) synthetic carbonated drink and the pouring mouth was sealed. The heat sterilization was carried out at 42° C. in a can warmer.

During the above treatment, peeling or leakage was not caused in the circumferential seam formed by bonding.

So-prepared vessels were packed into a carton case (24 cans/case) and were subjected to the shaking test and falling test. In any of the vessels, deformation or breakage of the bonded portion between the upper and lower members or leakage of the content from the bonded portion was not caused at all.

EXAMPLE 2

A draw-ironed metal vessel having a circumferential side seam was prepared in the same manner as described in Example 1 except that the punching diameter in the upper member was changed to 78 mm and the plastic forming ratio (R) was changed to 1.21.

The dimensions and physical values of the upper member were as follows:
Thickness of side wall: 0.23 mm
Weight of upper member: 7.98 g
Inner diameter of pouring mouth: 21.6 mm
Average inner diameter of side wall: 64.5 mm

EXAMPLE 3

A metal vessel was prepared in the same manner as described in Example 1 except that the punching diameter in the upper member was changed to 105.1 mm and the plastic forming ratio (R) was changed to 1.63.

The dimensions and physical values of the upper member were as follows:
Thickness of side wall: 0.23 mm
Weight of upper member: 15.02 g
Inner diameter of pouring mouth: 21.6 mm
Average inner diameter of side wall: 64.5 mm

EXAMPLE 4

A metal vessel having a circumferential side seam was prepared in the same manner as described in Example 1 except that the ironing ratio ($R_I$) of the side wall of the lower member was changed to 75%.

EXAMPLE 5

A metal vessel was prepared in the same manner as described in Example 1 except that the ironing ratio ($R_I$) of the side wall of the lower member was changed to 30%.

COMPARATIVE EXAMPLE 1

A metal vessel was prepared in the same manner as described in Example 1 except that an ironing punch having a diameter of 131 mm was used for ironing forming of the lower member, the punching diameter of the upper member was changed to 140.2 mm and the plastic forming ratio (R) was changed to 1.08. The dimensions and physical values of the upper member were as follows:
Thickness of side wall: 0.23 mm
Weight of upper member: 25.56 g
Inner diameter of pouring mouth: 40.5 mm
Average inner diameter of side wall: 129.8 mm

COMPARATIVE EXAMPLE 2

A metal vessel having a circumferential side seam was prepared in the same manner as described in Example 1 except that the plastic forming ratio (R) of the upper member was changed to 2.0.

COMPARATIVE EXAMPLE 3

A metal vessel was prepared in the same manner as described in Example 1 except that the ironing ratio ($R_I$) of the lower member was changed to 15%.

Metal vessels obtained in Examples 2 through 5 and Comparative Examples 1 through 3 were packed with the above-mentioned drink and sterilized in the same manner as described in Example 1.

In the vessels obtained in Examples 2 through 5, as in the vessel obtained in Example 1, peeling or leakage was not caused in the circumferential bonded seam. In case of the vessels obtained in Comparative Examples 1 through 3, peeling or leakage was often observed in the circumferential bonded seam after the treatment, and when these vessels of the Comparative Examples were subjected to the shaking test and falling test, deformation or breakage in the bonded portion between the upper and lower members was caused, resulting in leakage of the content.

The metal vessels obtained in Examples 1 through 5 and Comparative Examples 1 through 3 were subjected to the bonding strength test and leakage test. The obtained results are shown in Table 1.

TABLE 1

| | Ironing Ratio (%) of Lower Member | Plastic Forming Ratio of Upper Member | Bonding Strength (Kg/cm) | | Leakage Ratio | |
|---|---|---|---|---|---|---|
| | | | just after packing and sterilization | after 3 months' standing at 50° C. | just after packing and sterilization | after 3 months' standing at 50° C. |
| Example 1 | 66.7 | 1.41 | 5.6 | 4.2 | 0/1000 | 0/1000 |
| Example 2 | 66.7 | 1.21 | 4.7 | 4.1 | 0/1000 | 0/1000 |
| Example 3 | 66.7 | 1.63 | 5.0 | 3.5 | 0/1000 | 0/1000 |
| Example 4 | 75.0 | 1.41 | 5.1 | 3.4 | 0/1000 | 0/1000 |
| Example 5 | 30.0 | 1.41 | 4.5 | 3.5 | 0/1000 | 0/1000 |
| Comparative Example 1 | 66.7 | 1.08 | 0.4 | 0.2 | 25/1000 | 812/1000 |
| Comparative Example 2 | 66.7 | 2.00 | 0.8 | 0.1 | 3/1000 | 981/1000 |
| Comparative Example 3 | 15.0 | 1.41 | 0.9 | 0.3 | 6/1000 | 684/1000 |

From the results shown in Table 1, it will readily be understood that the vessels obtained in Examples 1 through 5 according to the present invention by using the ironed lower member and the upper member drawn at a plastic forming ratio of from 1.1 to 1.8 and forming a circumferential side seam by lap-bonding the open end portions of the upper and lower members are improved in the bonding strength of the bonded portion over the metal vessels obtained in Comparative Examples 1 through 3, and that the risk of leakage in the bonded portion is remarkably reduced in the vessels obtained according to the present invention. Thus, it will readily be understood that excellent metal vessels are provided according to the present invention.

We claim:

1. A metal vessel which comprises a bottomed cup-shaped lower member composed of tin-plated steel sheet which has been drawn and ironed to an ironing ratio ($R_I$) of at least 20% as defined by the formula $$R_I = \frac{T_B - T_W}{T_B} \times 100$$

wherein $T_B$ is the thickness of the bottom wall of the cup-shaped body, and $T_W$ is the thickness of the side wall of the cup-shaped body and a primer coating applied to the drawn and ironed tin-plated steel sheet;

a cup-shaped primer coated tin-plated steel sheet upper member having a side wall and a top wall, the top wall having a pouring mouth of small diameter in the central portion thereof, said side wall being formed by draw-forming the primer-coated tin-plated steel sheet having a tin oxide layer between the tin-plating and primer at a side wall plastic forming ratio R of from 1.1 to 1.8 as defined by the formula $$R = \left(\frac{4W}{\pi t \rho} + D_0^2\right)^{\frac{1}{2}} / D_1$$

wherein W stands for the weight (g) of the blank of the upper member, t stands for the thickness (cm) of the blank of the upper member at the side wall, $\rho$ stands for the density (g/cm$^3$) of the blank of the upper member, $D_0$ stands for the inner diameter (cm) of the pouring mouth of the upper member, and $D_1$ stands for the average inner diameter (cm) of the side wall, whereby cracks are formed in the tin oxide layer to expose the underlying portions of the tin plating, and the primer coating fills the cracks and contacts the exposed portions of the tin plating to form a strong bonding contact between the primer coating and the tin plating;

the cup-shaped lower member and cup-shaped upper member being circumferentially lap-bonded to each other at the circumferential open-end portions thereof though an organic adhesive interposed between the primer coating applied to the side wall of the lower member and the primer coating applied to the side wall of the upper member.

2. A metal vessel as set forth in claim 1, wherein the side wall of the lower member is formed by ironing a tin-plated steel sheet at an ironing ratio of from 30 to 80%.

3. A metal vessel as set forth in claim 1, wherein the side wall plastic forming ratio R in the upper member is in the range of from 1.15 to 1.6.

4. A metal vessel as set forth in claim 1, wherein the tin coating weight in the tin-plated steel sheet is 0.1 to 1.0 pound per base box.

5. A metal vessel as set forth in claim 1, wherein the dimensions of the open end portions of the upper and lower members are selected so that the relation of $r_O - r_I < d_A$ in which $r_I$ stands for the inner diameter of the open end portion located on the inner side of the seam, $r_O$ stands for the inner diameter of the open end portion located on the outer side of the seam and $d_A$ stands for the thickness of the adhesive layer interposed between both the open end portions is established.

6. A metal vessel as set forth in claim 1, wherein the primer coating applied to the lower member is composed of a protective paint selected from the group consisting of a modified epoxy resin, a vinyl resin paint, a modified vinyl resin paint, an acrylic resin paint and a synthetic rubber paint.

7. A metal vessel as set forth in claim 1, wherein the primer coating applied to the upper member has an elasticity modulus of $10^7$ to $10^{12}$ dyne/cm$^2$.

8. A metal vessel as set forth in claim 1, wherein the organic adhesive is a heat-fusion-bondable thermo-plastic resin having a melting point or softening point of 130° to 240° C.

9. A metal vessel as set forth in claim 8, wherein the organic adhesive is selected from the group consisting of a nylon type adhesive, a polyester type adhesive and an olefin type adhesive.

10. A circumferential lap seam bonded metal vessel comprising upper and lower tin-plated steel-sheet cup members lap-bonded to each other through an organic adhesive;

the lower member comprising a drawn and ironed tin-plated steel sheet having a relatively thick bottom wall and relatively thin side wall with a primer coating layer applied to the inner wall surface of the drawn and ironed sheet;

the upper member comprising a side wall and a top wall having an outlet opening of relatively small diameter located in the central portion thereof, said side wall comprising a steel substrate, a tin plating layer on the steel substrate, a discontinuous layer of tin oxide on the tin plating layer, and a layer of primer coating on the tin oxide layer, said primer coating filling the discontinuities in the tin oxide layer and being bonded to the tin plating layer;

said organic adhesive being interposed in the lap bonded seam between the primer coating layers applied to the side walls of each of the upper and lower members.

* * * * *

UNITED STATES PATENT AND TRADEMARK OFFICE

CERTIFICATE OF CORRECTION

PATENT NO. : 4,863,063

DATED : September 5, 1989

INVENTOR(S) : KATSUHIRO IMAZU ET AL.

It is certified that error appears in the above-identified patent and that said Letters Patent is hereby corrected as shown below:

On the cover page of the patent, under "Related U.S. Application Data", "November 19, 1983" should read --November 10, 1983--.

Claim 8, lines 2 and 3 of the claim, "thermo-plastic" should read --thermoplastic--.

Signed and Sealed this

Thirtieth Day of October, 1990

*Attest:*

HARRY F. MANBECK, JR.

*Attesting Officer*

*Commissioner of Patents and Trademarks*